US009464820B2

(12) United States Patent
Ramacciotti

(10) Patent No.: US 9,464,820 B2
(45) Date of Patent: Oct. 11, 2016

(54) SURFACE MOUNTED HEATER WITH UNIVERSAL SEAL FITTING

(71) Applicant: MARCHI THERMAL SYSTEMS, Foster City, CA (US)

(72) Inventor: Michael Ramacciotti, Fremont, CA (US)

(73) Assignee: MARCHI THERMAL SYSTEMS, Foster City, CA (US)

( * ) Notice: Subject to any disclaimer, the term of this patent is extended or adjusted under 35 U.S.C. 154(b) by 316 days.

(21) Appl. No.: 14/217,322

(22) Filed: Mar. 17, 2014

(65) Prior Publication Data

US 2014/0263280 A1 Sep. 18, 2014

Related U.S. Application Data

(60) Provisional application No. 61/801,482, filed on Mar. 15, 2013.

(51) Int. Cl.

| | |
|---|---|
| ***H05B 3/34*** | (2006.01) |
| ***F24H 3/00*** | (2006.01) |
| ***H05B 3/06*** | (2006.01) |
| ***F24H 9/18*** | (2006.01) |
| ***F24H 9/20*** | (2006.01) |
| *F24H 3/04* | (2006.01) |

(52) U.S. Cl.

CPC ..... *F24H 3/002* (2013.01); *F24H 9/1863* (2013.01); *F24H 9/2071* (2013.01); *H05B 3/06* (2013.01); *F24H 3/0447* (2013.01); *F24H 2250/02* (2013.01)

(58) Field of Classification Search

CPC .... F24H 3/002; F24H 3/0447; F24H 9/1863; F24H 9/2071; F24H 2250/02; H05B 3/06

See application file for complete search history.

(56) References Cited

U.S. PATENT DOCUMENTS

2011/0186151 A1* 8/2011 Sparazynski ..... B60T 17/02 137/526

* cited by examiner

*Primary Examiner* — Shawntina Fuqua

(74) *Attorney, Agent, or Firm* — Law Office of Dorian Cartwright

(57) ABSTRACT

A surface mounted heater includes a universal seal fitting. A first aperture in the substrate secures the substrate to an inlet gas valve of the component. The first aperture has a scalloped radii with a first radii and a second radii. The first radii corresponds to a first type of component seal and the second radii corresponding to a second type of component seal.

10 Claims, 3 Drawing Sheets

SURFACE MOUNTED HEATER WITH UNIVERSAL SEAL FITTING

CROSS-REFERENCES TO RELATED APPLICATIONS

This application claims the benefit of priority under 35 U.S.C. 119(e) to U.S. Application No. 61/801,482, filed Mar. 15, 2013 entitled SURFACE MOUNTED HEATER WITH UNIVERSAL SEAL FITTING, submitted by Michael Ramacciotti, the contents of which are hereby incorporated herein by reference.

TECHNICAL FIELD

Embodiments of the invention relate generally to a heating circuit, and more specifically, incorporating a universal seal fitting for a surface mounted heater used for gas supply lines in semiconductor processing.

BACKGROUND

Semiconductor processing demands a chain of highly accurate instruments. During the etching process, material is moved from a semiconductor substrate in accordance with a masked pattern, by a bombardment of ions. In particular, one or more reactive gases such as fluorocarbon, oxygen or boron trichloride are treated to a certain temperature and flow rate by several components.

Problematically, as gas moves through a gas supply line and is treated to a certain temperature and mass flow rate, the gas often cools and, as a result, forms condensation along the gas supply line. The condensation can collect at joints along the gas supply line to the extent that there is blockage preventing an accurate delivery of gas. To address the issue, surface mounted heaters are placed along the gas supply line to keep the gas above a certain temperature.

However, because there are multiple sizes of components used in semiconductor processing, conventional surface mounted heaters are matched to a particular type of component. For example, components can use a KIS or a Toron type of seal to connect the component to a manifold, each of which has a different size.

What is needed is a surface mounted heater with a universal seal fitting, to overcome the deficiencies of the prior art.

SUMMARY

The present invention addresses the shortcomings of the prior art by providing devices and methods for a surface mounted heater with a universal seal fitting.

In one embodiment, a substrate has a heating element formed by electrically resistant material. The substrate to heat a gas in the gas supply line to a predetermined temperature as the gas enters and exits a component attached to the manifold.

In an embodiment, a first aperture in the substrate secures the substrate to an inlet gas valve of the component. The first aperture has a scalloped radii with a first radii and a second radii. The first radii corresponds to a first type of component seal and the second radii corresponding to a second type of component seal.

In yet another embodiment, a second aperture in the substrate for secures the substrate to an outlet gas valve of the component. The second aperture having the scalloped radii with the first radii and the second radii. The first radii corresponds to the first type of component seal and the second radii corresponding to the second type of component seal.

Advantageously, semiconductor processing components can be quickly reconfigured for different processes.

The Figures depict various embodiments for purposes of illustration only. One skilled in the art will readily recognize from the following discussion that other embodiments of the structures and methods illustrated herein may be employed without departing from the described principles.

DETAILED DESCRIPTION

Figure 1:
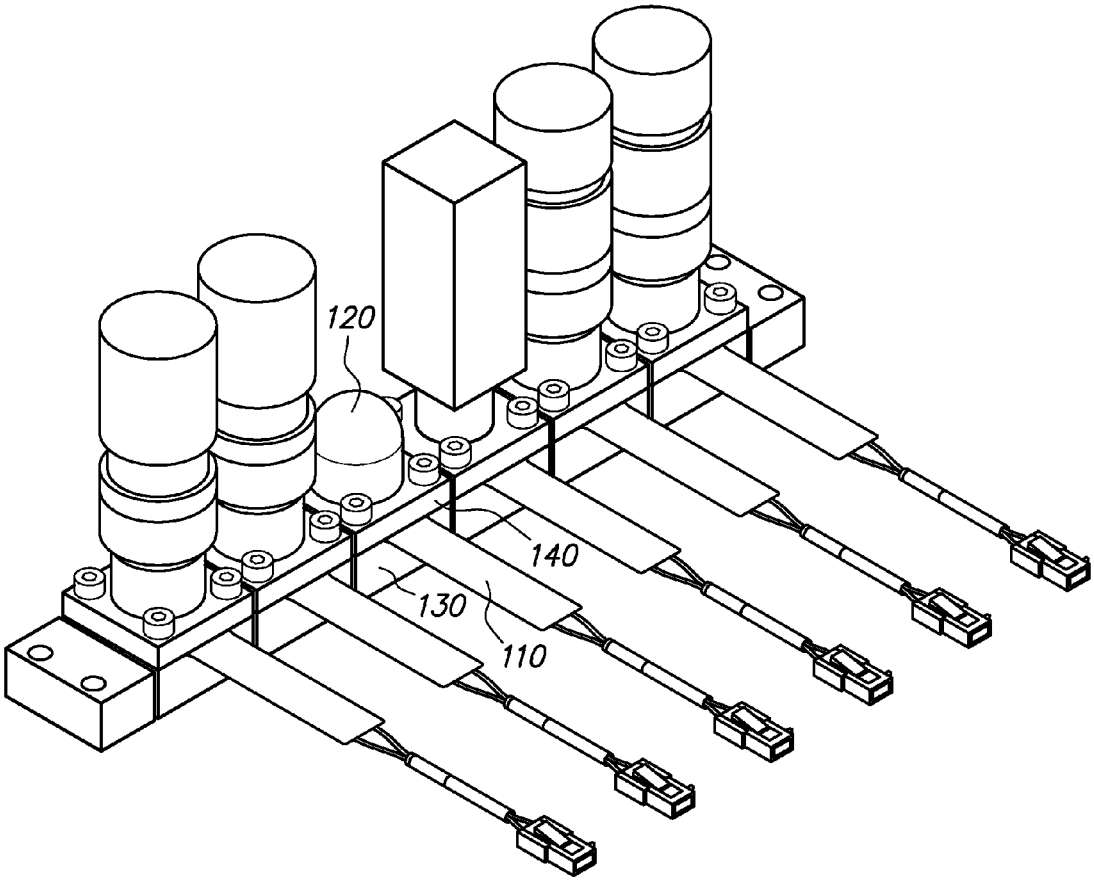
FIG. 1 is a schematic diagram illustrating a manifold assembly for a semiconductor processing having several components to treat a gas supply line with surface mounted heaters, according to an embodiment.

FIG. 1 is a schematic diagram illustrating a manifold assembly 100 for a semiconductor processing having several components 120 to treat a gas supply line with surface mounted heaters 110, according to an embodiment. The manifold assembly 100 is a tool used in, for example, a clean room to create semiconductor chips used in an electronic products. Process gas, fluid, gas and fluids, or and slurries are exposed to various processes to regulate temperature, mass flow rate, volume, pressure, and the like.

Surface mounted heaters 110 are sandwiched between a base 130 and interface blocks 140 of process components 120. A relatively thin profile allows surface mounted heaters 110 to be added between the base 130 and interface blocks 140 in a substantially non-interfering manner. Surface mounted heaters 110 are connected together along a common power line providing power for heat generation. As process gas progresses through the base 130, or is stored within components 120, surface mounted heaters 110 regulate temperature within certain tolerances. Condensation can be minimized, and tool accuracy maintained, by keeping the process gas above a certain temperature.

In one embodiment, surface mounted heaters 110 include one or more universal seal fittings, enabling use varying types (or sizes) of seals. In some embodiments, C-seals of K1S or Talon types are suitable. Additional details for surface mounted heaters 110 are set forth below.

Process components 120 can be one or more of MFCs (mass flow controllers), electronic regulators, mixing chambers, pressure transducers, valves, filters, and the like.

The base 130 forms a common substrate for process components 120. Interface blocks 140 attached to any suitable component adapts that component for integration to the manifold assembly 100. Depending on the process, process components 120 can be reconfigured to include more or less components, different components, or re-ordered components. To do so, fasteners are loosened or unlocked so that the interface blocks 140 are removable from the base 130. New components can be tightened or locked back in with the same fasteners.

Figure 2:
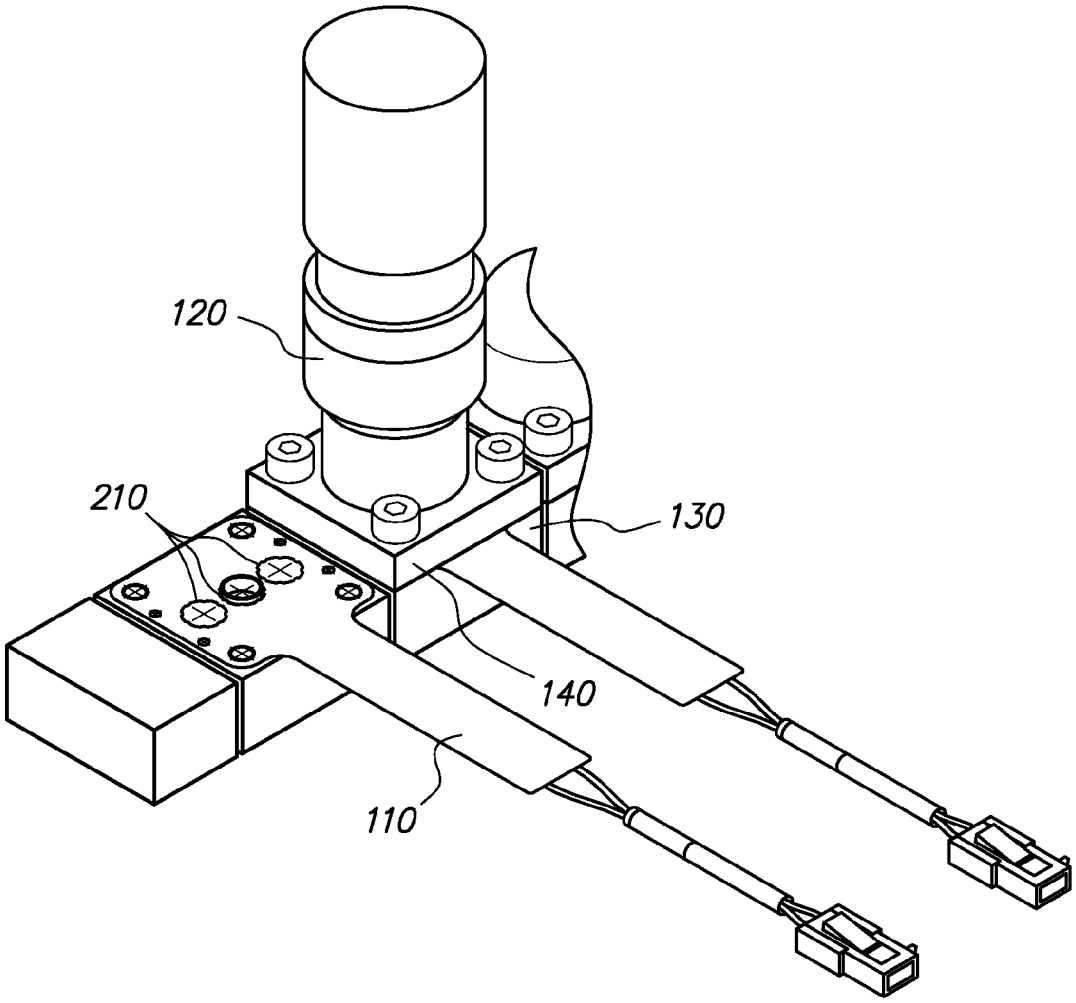
FIG. 2 is a schematic diagram illustrating a partial break out view of FIG. 1, showing a surface mounted heater as connected to the manifold assembly with a processing component removed, according to an embodiment.

FIG. 2 is a schematic diagram illustrating a partial break out view of FIG. 1, showing a surface mounted heater 110 as connected to the manifold assembly 100 with a processing component 120 removed, according to an embodiment. As shown, C-seals keep the surface mounted heater 110 in position.

Figure 3:
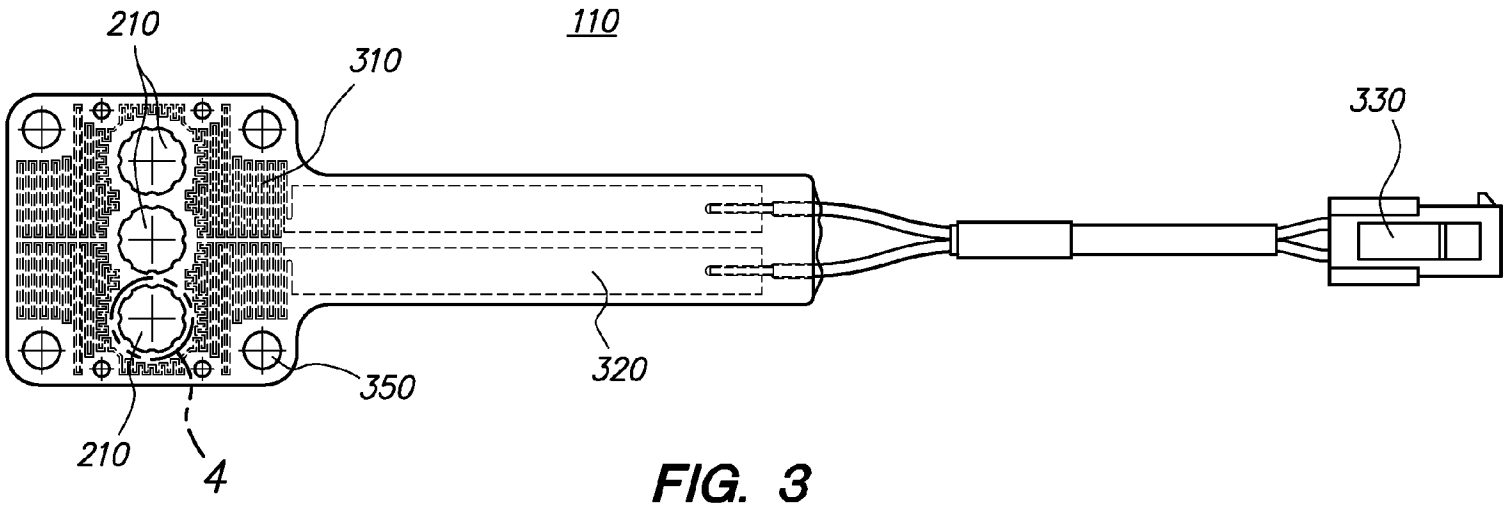
FIG. 3 is a more detailed schematic diagram illustrating a surface mounted heater, according to an embodiment.

FIG. 3 is a more detailed schematic diagram illustrating the surface mounted heater 110 with universal seal fittings 340, according to an embodiment.

The embodiment shows three universal seal fittings 340 although there can be any number implemented. For example, a single aperture is needed for a pressure transducer, two apertures for an inlet and outlet, and a third optional aperture can be used to detect leaks. The universal seal fittings 340 are adaptable for compatibility more than one standard for fasteners, as is discussed in more detail below. Process gas or fluids pass through the universal seal fittings 340 during progression from an inlet from the base 130, to the component 120, and then to an outlet of the base 130. One universal seal fitting 340 can fit the inlet and another seal fitting can 340 can fit the outlet.

A heating coil 310 is formed from an etched foil resistive material (e.g., stainless steel). Other manufacturing processes for resistive material can be substituted. The heating coil 310 is tightly wound in FIG. 3 in order to maximize heat generation. When an electrical current is passed through the heating coil 310, resistance generates heat which is radiated to process gases. A flexible surface covering the heating coil 310 can be chemically and electrically insulating while having low heat impedance.

Fastener holes 350 at four corners permit fasteners to sandwich the surface mounted heater 340 between the interface 140 and the base 130.

Electrical conductors 320 provide a path for electrical current between a connector 330 and the heating coil 310. The same resistive material can be used in electrical conductors 320 as the heating coil 310 if desired. The connector 330 connects the surface mounted heater 310 to an AC or DC power source (not shown). Power can be drawn in parallel or in series with other heaters also connected to a common power line.

Figure 4:
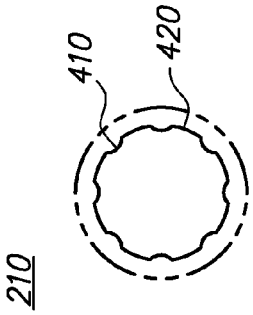
FIG. 4 is a more detailed schematic diagram of a universal seal fitting of FIG. 3, according to an embodiment.

FIG. 4 is a more detailed schematic diagram of the universal seal fitting 340 of FIG. 3, according to an embodiment.

The universal seal fitting 340 comprises an aperture in a substrate. The aperture has a scalloped radii with a first radii 410 and a second radii 420 of different sizes. The first radii corresponds to a first type of component seal (e.g., K1S type seal) and the second radii corresponding to a second type of component seal (e.g., Talon type seal).

The example of FIG. 4 includes eight sections of inner radii 410 and eight sections of outer radii 420. As a result, center lines between the eight sections is 45 degrees, and center lines between adjacent sections is approximately 23 degrees. The separation distance varies with the number of sections. Some embodiments use more sections for a tighter fit to seals while other embodiments use fewer sections to receive larger external diameter seals.

In operation, when a seal type corresponding to the first radii 410 is applied, sections having the first radii 410 are in contact to secure the surface mounted heater 110. However, when a seal type corresponding to the second radii 420 is applied, flexible sections having the first radii 410 fold back to give way to sections corresponding to the second radii 420. Additionally, the folded back sections also in contact.

In yet another embodiment, a second aperture in the substrate for secures the substrate to an outlet gas valve of the component. The second aperture having the scalloped radii with the first radii and the second radii. The first radii corresponds to the first type of component seal and the second radii corresponding to the second type of component seal.

As will be understood by those familiar with the art, the invention may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the invention or its features may have different names, divisions and/or formats.

Accordingly, the disclosure of the present invention is intended to be illustrative, but not limiting, of the scope of the invention.

I claim:

1. A surface mounted heater with universal seal fittings for semiconductor processing, the surface mounted heater to control temperature of a gas supply line that spans components along a manifold, comprising:

a substrate having a heating element, the substrate being thermally conductive and electrically resistive, the heating element having a resistance that generates heat responsive to an electrical current to heat a process gas in the gas supply line to a predetermined temperature;

a first aperture in the substrate for allowing a component contact with a process gas, the first aperture having a scalloped radii with a first radii and a second radii, the first radii smaller than the second radii, the first radii corresponding to a first type of component seal and the second radii corresponding to a second type of component seal; and a power connector coupled to the substrate to connect an electrical power source to the heating element.

2. The heater of claim 1, wherein the inner diameter corresponds to a K1S C-seal component fitting.

3. The heater of claim 1, wherein the outer diameter corresponds to a Talon C-seal component fitting.

4. The heater of claim 1, wherein the first radii includes sections that contact a component seal having a first radii, while the second radii includes sections that do not contact the component seal when in place.

5. The heater of claim 1, wherein the substrate is formed from a flexible material allowing sections having the first radii to fold when adapting the aperture to the second radii.

6. The heater of claim 1, wherein:

the first aperture in the substrate secures the substrate to an inlet gas valve of the component, the first aperture having a scalloped radii with a first radii and a second radii, the first radii corresponding to a first type of component seal and the second radii corresponding to a second type of component seal.

7. The heater of claim 1, further comprising:

a second aperture in the substrate secures the substrate to an outlet gas valve of the component, the second aperture having the scalloped radii with the first radii and the second radii, the first radii corresponding to the first type of component seal and the second radii corresponding to the second type of component seal.

8. The heater of claim 1, wherein the surface mounted heater is disposed between a base providing connections for a plurality of process components and a component interface that connects to the base.

9. The heater of claim 1, wherein the heating element is disposed to heat the process gas while in a component.

10. The heater of claim 1, wherein the component comprises one of an MFC (mass flow controller), an electronic regulator, a mixing chamber, a pressure, a transducer, valve, and a filter.

* * * * *